US009995476B2

(12) United States Patent
Xiong et al.

(10) Patent No.: US 9,995,476 B2
(45) Date of Patent: Jun. 12, 2018

(54) LIGHTING DEVICE AND LUMINAIRE

(71) Applicant: PHILIPS LIGHTING HOLDING B.V., Eindhoven (NL)

(72) Inventors: Yan Xiong, Eindhoven (NL); Hongxia Li, Eindhoven (NL); Zhenning Yao, Eindhoven (NL); ZhenXuan Lin, Eindhoven (NL); Bao Wang, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 199 days.

(21) Appl. No.: 15/028,885

(22) PCT Filed: Sep. 19, 2014

(86) PCT No.: PCT/IB2014/064649
§ 371 (c)(1),
(2) Date: Apr. 12, 2016

(87) PCT Pub. No.: WO2015/052608
PCT Pub. Date: Apr. 16, 2015

(65) Prior Publication Data

US 2016/0252216 A1 Sep. 1, 2016

(30) Foreign Application Priority Data

Oct. 12, 2013 (WO) ..... PCT/CN2013/001226
Nov. 13, 2013 (WO) ..... PCT/CN2013/001382

(51) Int. Cl.
*F21S 4/00* (2016.01)
*F21V 21/00* (2006.01)
(Continued)

(52) U.S. Cl.
CPC ..... *F21V 29/87* (2015.01); *F21K 9/1355* (2013.01); *F21K 9/232* (2016.08); *F21V 3/0445* (2013.01);
(Continued)

(58) Field of Classification Search
CPC ..... F21K 9/00; F21K 9/20; F21K 9/23; F21K 9/232; F21K 9/233; F21K 9/235;
(Continued)

(56) References Cited

U.S. PATENT DOCUMENTS

2012/0056542 A1 3/2012 Sung
2013/0148347 A1 6/2013 Huang

FOREIGN PATENT DOCUMENTS

CN 201496807 U 6/2010
CN 201954317 U 8/2011
(Continued)

*Primary Examiner* — Jason Moon Han

(57) ABSTRACT

In various embodiments, disclosed is a lighting device comprising a bulbous body mounted on a cap, and an inner surface of the bulbous body comprising a plurality of steps that are axially displaced relative to each other along a central axis of the lighting device. The plurality of steps comprising in one example a first step supporting a first plurality of solid state lighting elements; and a second step supporting a second plurality of solid state lighting elements, wherein the first step is located in between the cap and the second step. A luminaire including such a lighting device is also disclosed. The lighting device may further comprise a bulbous member separated from the cap by a transparent member having a stepped wall profile including the first step and the second step.

11 Claims, 8 Drawing Sheets

(51) Int. Cl.

| | |
|---|---|
| ***F21V 29/87*** | (2015.01) |
| ***F21K 9/232*** | (2016.01) |
| ***F21K 99/00*** | (2016.01) |
| ***F21V 3/04*** | (2018.01) |
| ***F21V 7/00*** | (2006.01) |
| ***F21V 23/00*** | (2015.01) |
| *F21V 3/02* | (2006.01) |
| *F21Y 115/10* | (2016.01) |
| *F21Y 103/33* | (2016.01) |
| *F21Y 107/60* | (2016.01) |
| *F21Y 101/00* | (2016.01) |

(52) U.S. Cl.
CPC ..... *F21V 7/00* (2013.01); *F21V 23/009* (2013.01); *F21V 3/02* (2013.01); *F21Y 2101/00* (2013.01); *F21Y 2103/33* (2016.08); *F21Y 2107/60* (2016.08); *F21Y 2115/10* (2016.08)

(58) Field of Classification Search
CPC ..... F21K 9/237; F21V 7/00; F21V 23/007–23/009; F21V 29/87; F21Y 2107/60
USPC ..... 362/249.02, 311.02, 645–659
See application file for complete search history.

(56) References Cited

FOREIGN PATENT DOCUMENTS

| | | | |
|---|---|---|---|
| EP | 2447597 | A1 | 5/2012 |
| JP | 2012181969 | A | 9/2012 |
| WO | WO2008041587 | A1 | 4/2008 |
| WO | WO2011100195 | A1 | 8/2011 |

LIGHTING DEVICE AND LUMINAIRE

CROSS-REFERENCE TO PRIOR APPLICATIONS

This application is the U.S. National Phase application under 35 U.S.C. § 371 of International Application No. PCT/IB2014/064649, filed on Sep. 19, 2014, which claims the benefit of Chinese Applications Nos. PCT/CN2013/001382, filed Nov. 13, 2013 and PCT/CN2013/001226, filed Oct. 12, 2013. These applications are hereby incorporated by reference herein.

FIELD OF THE INVENTION

The present invention relates to a lighting device comprising a bulbous body and a cap.

The present invention further relates to a luminaire comprising such a lighting device.

BACKGROUND OF THE INVENTION

Solid state lighting (SSL) is rapidly becoming the norm in many lighting applications. This is because SSL elements such as light emitting diodes (LEDs) exhibit superior lifetime and energy consumption compared to traditional alternatives such as incandescent and fluorescent lighting devices, e.g. light bulbs.

However, there are still difficulties to overcome in order to improve customer satisfaction and increase market penetration. For instance, SSL element-based lighting devices are often perceived to create light that is less aesthetically pleasing compared to traditional alternatives. For instance, the filament of an incandescent light bulb produces more or less omnidirectional light whereas SSL elements tend to produce light under a range of angles of 180° or less due to the fact that the SSL elements can be considered point sources mounted on a carrier surface, wherein the light is generated away from the surface.

This means that for a SSL element-based lighting device such as a light bulb, additional measures must be taken to emulate the omnidirectional luminous distribution from its traditional counterparts. This may for instance be achieved using additional optical elements, e.g. reflectors. However, the integration of such additional optical elements tends to compromise the aesthetic appearance of the lighting device.

In addition, in order to achieve a luminous output that is equivalent in intensity to a traditional counterpart, a SSL element-based lighting device typically comprises a plurality of SSL elements. Such elements generate a significant amount of heat, which needs to be effectively dissipated in order to maintain the operating temperature of the SSL element-based lighting device within a desired range, e.g. to avoid the temperature-dependent colour variation in the luminous output of the SSL elements. To this end, the SSL element-based lighting device typically comprises a metal heat sink thermally coupled to the SSL elements. An example of a LED bulb including such a heat sink is shown in CN 201 954 317 U. However, such a heat sink is unsightly as well as costly and clearly distinguishes the appearance of the SSL element-based lighting device from its traditional counterparts. This hampers the market penetration of SSL element-based lighting devices.

SUMMARY OF THE INVENTION

The present invention seeks to provide a more cost-effective lighting device according to the opening paragraph.

The present invention further seeks to provide a luminaire including such a lighting device.

Embodiments of the invention are defined by the claims.

According to an aspect, there is provided a lighting device comprising a bulbous body mounted on a cap, an inner surface of the bulbous body comprising a plurality of steps that are axially displaced relative to each other along a central axis of the lighting device, said plurality of steps comprising a first step supporting a first plurality of solid state lighting elements and a second step supporting a second plurality of solid state lighting elements, wherein the first step is located in between the cap and the second step.

The lighting device of the present invention has at least two tiers of SSL elements on the axially displaced steps inside the bulbous body. This ensures a goof thermal coupling between the SSL elements and the bulbous body, such that a separate metal heat sink can be omitted from the design of the lighting device. This not only reduces the cost of the lighting device but furthermore improves its appearance.

In one embodiment, the lighting device comprises a bulbous member separated from the cap by a transparent member having a stepped wall profile including the first step and the second step, wherein the first plurality of solid state lighting elements and the second plurality of solid state lighting elements are arranged to emit light towards the bulbous member; the second step is located in between the first step and the bulbous member and has a larger diameter than the first step; and the transparent member and the bulbous member combine to form the bulbous body.

In an embodiment, at least one of the transparent member and the bulbous member is made of a polymer material. In a preferred embodiment, the transparent member is made of a thermal plastic such as polyphenylene sulfide (PPS), polycarbonate, polyethylene terephthalate or poly (methyl methacrylate), i.e. a plastic having favourable thermal conductivity properties. PPS is particularly preferred.

The transparent member may comprise an aperture facing the cap, a first sidewall extending from said aperture to the first step and a second sidewall extending from the first step to the second step.

The second sidewall may be diffusively transparent to reduce glare by an observer of the lighting device.

The second sidewall may taper from the second step to the first step in order to ensure that the second step has a wider diameter than the first step.

In another embodiment, the respective luminous surfaces of the first plurality of solid state lighting elements and the second plurality of solid state lighting elements face each other. In this embodiment, the first step and the second step may be located more centrally in the bulbous body, which yields a lighting device having a particularly high optical efficiency whilst maintaining an Energy Star luminous distribution, which can be manufactured at low cost.

In an embodiment, the bulbous body contains an annular protrusion delimited by the first step and the second step respectively.

In an embodiment, the cap comprises a driver circuit for driving the first plurality of solid state lighting elements and the second plurality of solid state lighting elements, which at least partially excludes the driver circuit from being visible to an external observer, thereby improving the appearance of the lighting device.

The driver circuit may extend into the bulbous body in case it is too large to fit in the cap.

In an embodiment, the first plurality of solid state lighting elements and the second plurality of solid state lighting elements are electrically connected to the driver circuit by respective flying wires. This is a particularly cost-effective way of connecting the respective pluralities of solid state lighting elements to the driver circuit.

In an embodiment, the first plurality of solid state lighting elements is mounted on a first carrier and the second plurality of solid state lighting elements is mounted on an annular second carrier. The annular second carrier ensures that the light generated by the first plurality of solid state lighting elements can enter the bulbous member through the central opening of the second carrier in the embodiment where the first step and the second step form part of the transparent member. The first carrier may also be an annular carrier in the embodiment where the steps are located more centrally in the bulbous body.

At least in the embodiment where the first step and the second step form part of the transparent member, at least one of the second step and the annular second carrier preferably has a reflective surface facing the first plurality of solid state lighting elements. The further increases the omnidirectionality of the light distribution produced by the lighting device; for instance in case of the lighting device being a light bulb, this may result in a light bulb producing an energy star luminous distribution.

At least in the embodiment where the first step and the second step form part of the transparent member, the surface of the second step facing the first plurality of solid state lighting elements may be a diffusive surface to increase scattering of incident light originating from the first plurality of solid state lighting elements.

In another embodiment, the bulbous member is a diffuser to provide a diffuse lighting device in which glare for an external observer is reduced.

According to another aspect, there is provided a luminaire comprising an embodiment of the lighting device of the present invention. Such a luminaire may for instance be a holder of the lighting device or an apparatus into which the lighting device is integrated.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
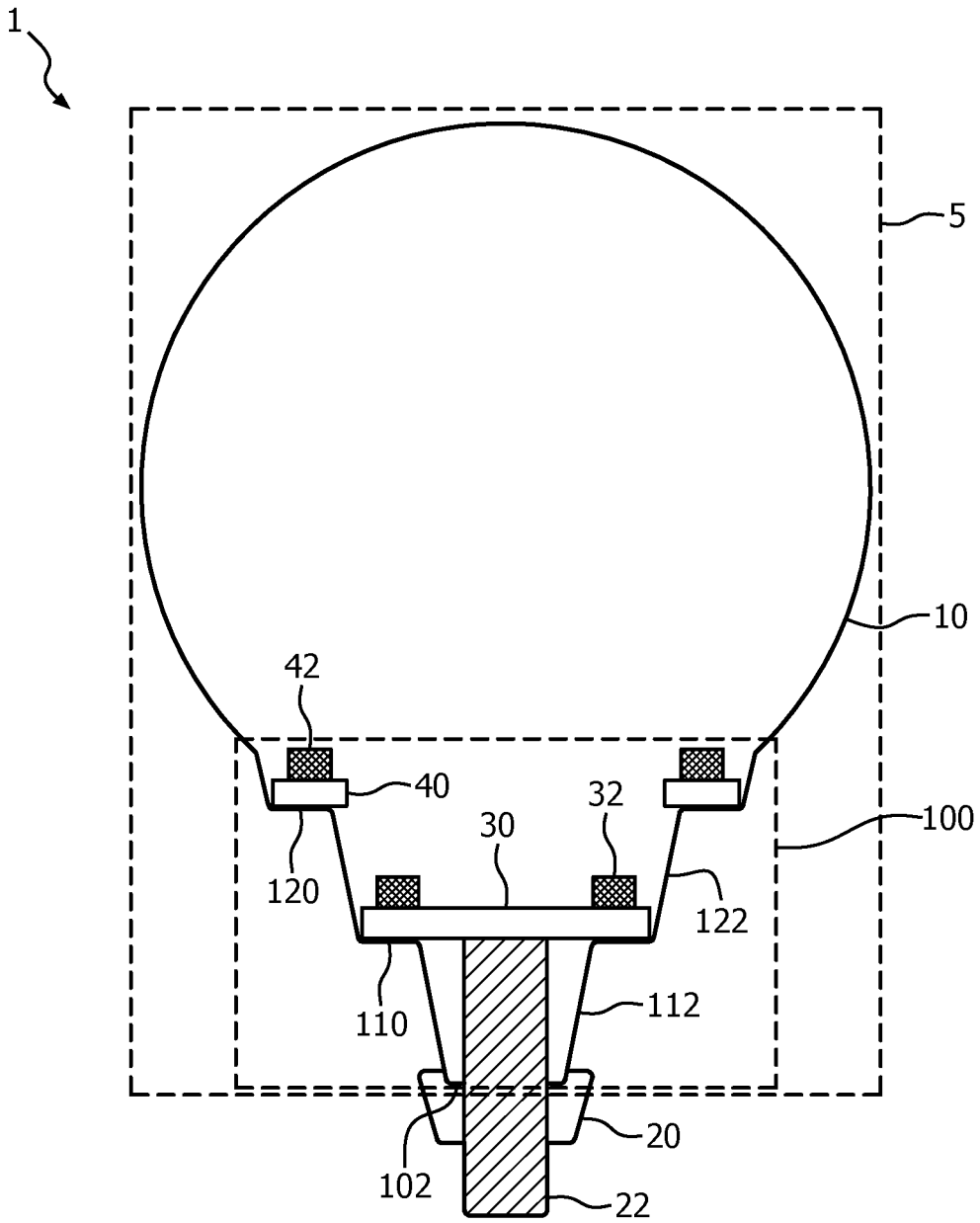
FIG. 1 schematically depicts a cross-section of a lighting device according to an embodiment of the present invention.

It should be understood that the FIG.s are merely schematic and are not drawn to scale. It should also be understood that the same reference numerals are used throughout the FIG.s to indicate the same or similar parts.

The present invention is based on the insight that a lighting device comprising a bulbous body, e.g. a light bulb, which lighting device comprises SSL elements, can be designed to include a plurality of tiers or steps at least including a first step and a second step on an inner surface of the bulbous body, which tiers can be spaced apart, i.e. axially displaced relative to each other along the central axis of the lighting device, such that the lighting device can produce a highly homogeneous luminous output such as an Energy Star-compliant luminous output.

Moreover, the need for a heat sink may be avoided as the bulbous body can be used to effectively dissipate the heat generated by the SSL elements. In some embodiments of the present invention, at least the part of the bulbous body comprising the tiers or steps may be formed from a thermal plastic, e.g. a polymer having a relatively high thermal conductivity in order to aid the heat dissipation. The desired luminous distribution and heat dissipation characteristics for instance may be achieved by appropriate spacing between the first and second steps.

In the context of the present application, a bulbous body typically comprises one or more parts through which the luminous output generated by the SSL elements exits the lighting device. The one or more parts may cooperate with each other or may be fused together to form the bulbous body.

Figure 2:
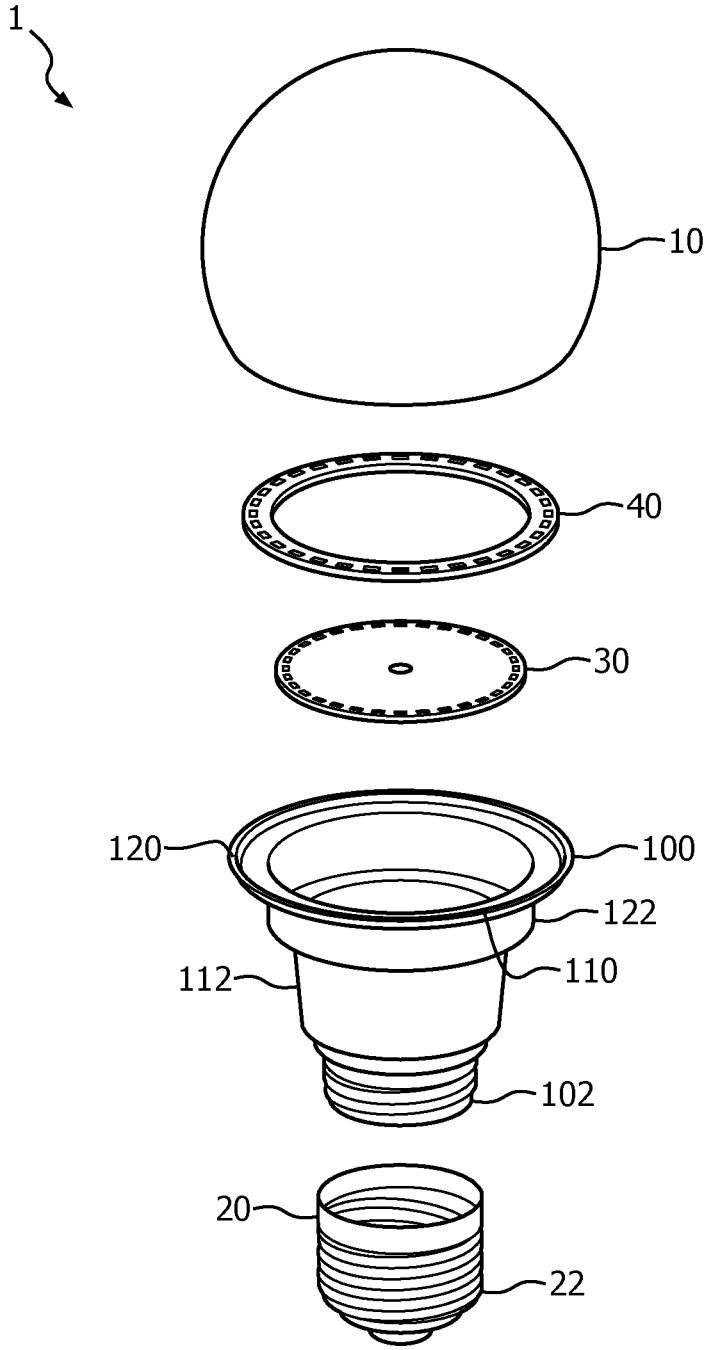
FIG. 2 schematically depicts an exploded view of the lighting device of FIG. 1.

FIG. 1 schematically depicts a cross section and FIG. 2 schematically depicts an exploded view of a lighting device 1 according to an embodiment of the present invention. The lighting device 1 comprises a bulbous member 10, which is separated from a cap 20 by a transparent member 100. The bulbous member 10 and the transparent member 100 may cooperate or may be fused together to form the bulbous body 5. In the context of the present invention, the term transparent is used to mean allowing light to pass through. This therefore is intended to include clear materials as well as diffuse materials, i.e. materials that diffuse light as it passes through these materials.

The transparent member 100 comprises a stepped wall profile including a first step 110 which supports a first plurality of solid state lighting (SSL) elements 32, which may be mounted on a carrier 30 such as a PCB (printed circuit board). The first plurality of SSL elements 32 may be arranged in an annular pattern on the first step 110, for instance in an annular pattern on the carrier 30. The transparent member 100 further comprises a second step 120 supporting a second plurality of SSL elements 42. The second step 120 is axially displaced relative to the first step 110 along the central axis of the lighting device 1. The second plurality of SSL elements 42 may be mounted on the second step 120 or on an annular carrier 40 supported by the second step 120. The annular carrier 40 may for instance be an annular PCB, which central opening allows for the light emitted by the first plurality of SSL elements 32 to reach the bulbous member 10.

In an embodiment, the transparent member 100 is made of a plastic or polymer material, preferably a plastic or polymer comprising good thermal conductivity. The separation provided between the first plurality of SSL elements 32 and the second plurality of SSL elements 42 by the stepped profile in the transparent member 100 ensures that the heat generated by these SSL elements can be effectively dissipated by the transparent member 100 without the need for additional heat dissipating elements, in particular a heat sink. Suitable embodiments of a plastic or polymer having good thermal conductivity include polyphenylene sulfide (PPS), polycarbonate, polyethylene terephthalate or poly (methyl methacrylate), i.e. a plastic having favourable thermal conductivity properties. PPS is particularly preferred.

In an embodiment, the bulbous member 10 is made of a suitable polymer material. Any polymer suitable for use in optical application domains may be used, such as polycarbonate, polyethylene terephthalate or poly (methyl methacrylate). The bulbous member 10 may be a transparent member or may be a diffuser depending on the application domain for the lighting device 1.

The transparent member 100 typically comprises a first sidewall 112 extending from the cap 22 the first step 110 and a second sidewall 122 extending from the first step 110 to the second step 120. In an embodiment, the second sidewall 122 tapers from the second step 120 to the first step 110. In other words, the diameter of the section of the transparent member 100 delimited by the second sidewall 122 gradually decreases in the direction from the second step 120 to the first step 110. The taper angle of the second sidewall 122 may be chosen to control the amount of light directly entering the bulbous member 10 through the opening defined by the second step 120 or the annular carrier 40. Similarly, the first sidewall 112 may taper from the first step 110 to the cap 20.

In order to improve the uniformity of the luminous distribution of the lighting device 1, the second step 120 may act as a reflective surface for incident light generated by the first plurality of SSL elements 32. This light may reach the second step 120 after having exited the transparent member 100 through the second sidewall 122. To this end, a reflective film (not shown) may be placed in between the second step 120 and the carrier 40 and/or the second plurality of SSL elements 42. Alternatively, the bottom surface of the annular carrier 40, i.e. the surface opposite the surface carrying the SSL elements 42, may be made reflective. According to yet another alternative embodiment, the second step 120 itself may be made reflective and/or may act as a diffuser. In certain embodiments, the combination of a diffusive bulbous member 10, a diffusive second sidewall 122 and a reflective second step 120 can yield a lighting device 1 producing a luminous distribution complying with the US Energy Star regulations.

In certain application domains, it may be desirable for the SSL elements 32 not to be directly visible to an external observer. To this end, the second sidewall 122 may be diffusively transparent. Preferably but not necessarily this is combined with the bulbous member 10 being diffusive as well, such that the SSL elements 42 also cannot be directly observed. The first sidewall 112 may also be diffusively transparent, although this is less relevant to the optical characteristics of the lighting device 1 given that the amount of light exiting the lighting device 1 through the first sidewall 112 is negligible in at least some embodiments. It may however improve the appearance of the lighting device 1 if the first sidewall 112 and the second sidewall 122 obscure the internals of the lighting device 1.

For instance, a driver circuit 22 for driving the first plurality of SSL elements 32 and the second plurality of SSL elements 42 may be mounted in the cap 20 and may extend into the transparent member 100 and into the bulbous body 5 through its aperture 102 in case the driver circuit 22 cannot fit inside the cap 20 in its entirety. Consequently, the diffusively transparent first sidewall 112 prevents the driver circuit 22 from being observed by an external observer, thereby improving the appearance of the lighting device 1.

In an embodiment, the first carrier 30 that carries the first plurality of SSL elements 32 may be a circular carrier extending over the full width of the transparent member 100 at the first step 110. In this embodiment, the first carrier 30 may be supported by the driver circuit 22 or by a portion of the cap 20 extending into the transparent member 100.

Figure 3:
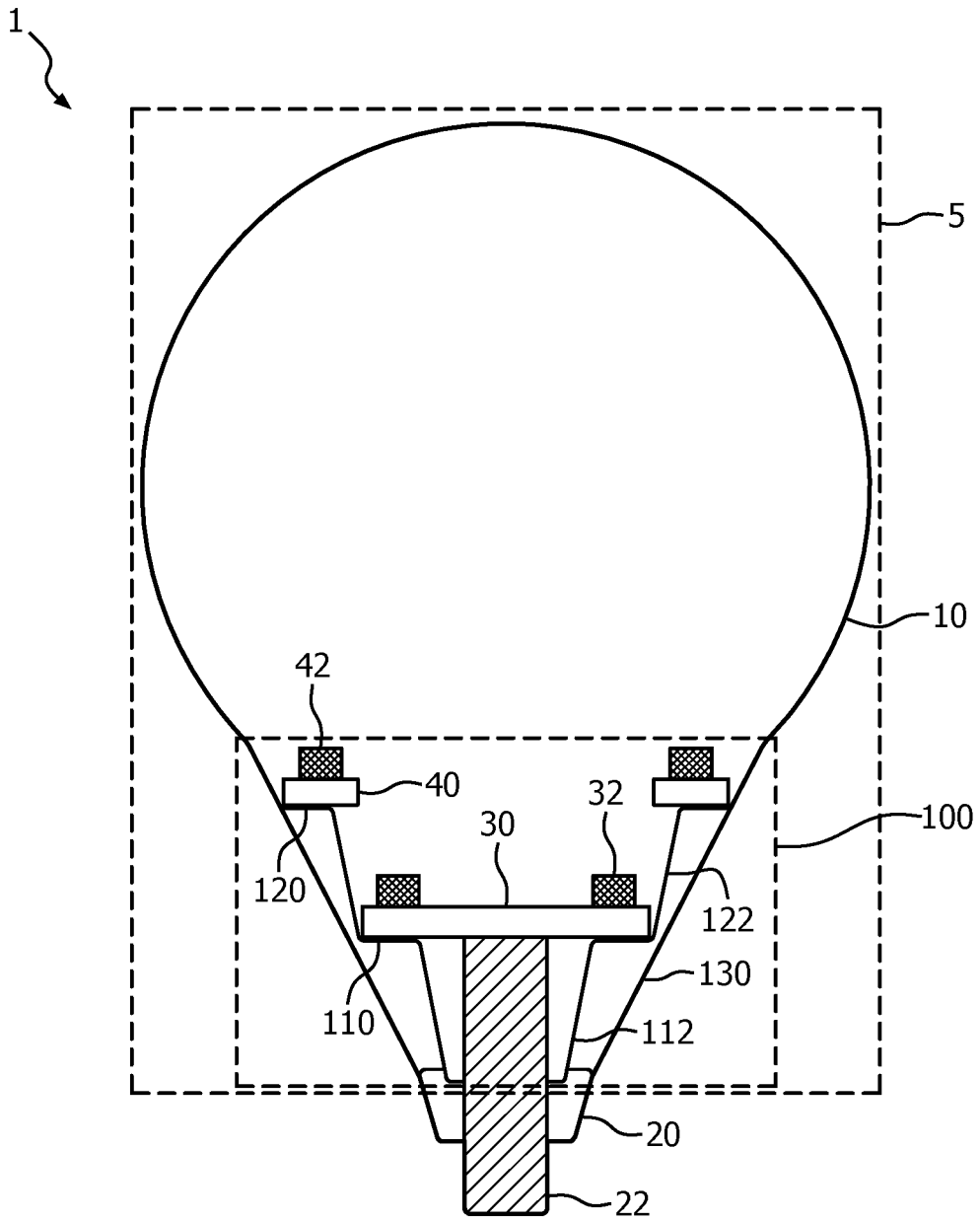
FIG. 3 schematically depicts a cross-section of a lighting device according to another embodiment of the present invention.

In the embodiment shown in FIG. 1 and FIG. 2, the transparent member 100 has a stepped profile in both its inner surface and outer surface. However, it should be understood that this is by way of non-limiting example only. It is for instance equally feasible that the transparent member 100 combines a stepped inner surface including the first step 110 and the second step 120 with a smooth outer surface, an embodiment of which is shown in FIG. 3. Such a smooth outer surface for instance may be considered more aesthetically pleasing in certain application domains.

At this point, it is noted that in the previous embodiments the transparent member 100 is shown to have a stepped wall profile including a first step 110 and a second step 120 each carrying a distribution of SSL elements by way of non-limiting example only. It should be understood that the number of steps in the stepped wall profile of the transparent member 100 can be extended if desired, for instance if a larger number of SSL elements is required and where the larger number of SSL elements cannot be fitted on to two steps whilst at the same time providing efficient heat dissipation for these SSL elements. For instance, the stepped wall profile may include a third step supporting a third plurality of solid state lighting elements arranged to emit light towards the bulbous member 10, wherein the third step is located in between the second step 120 and the bulbous member and has a larger diameter than the second step.

In a lighting device 1 according to an embodiment of the present invention, e.g. an 800 lm light bulb, the heat generated by the SSL elements is effectively dissipated by the transparent member 100, thereby demonstrating that such a light bulb can be made entirely from plastic without the need for metal components to dissipate the heat generated by the SSL elements, e.g. a metal heat sink. This is particularly the case if the transparent member 100 is made from a plastic or polymer having good thermal conductivity, e.g. a thermal plastic.

Figure 4:
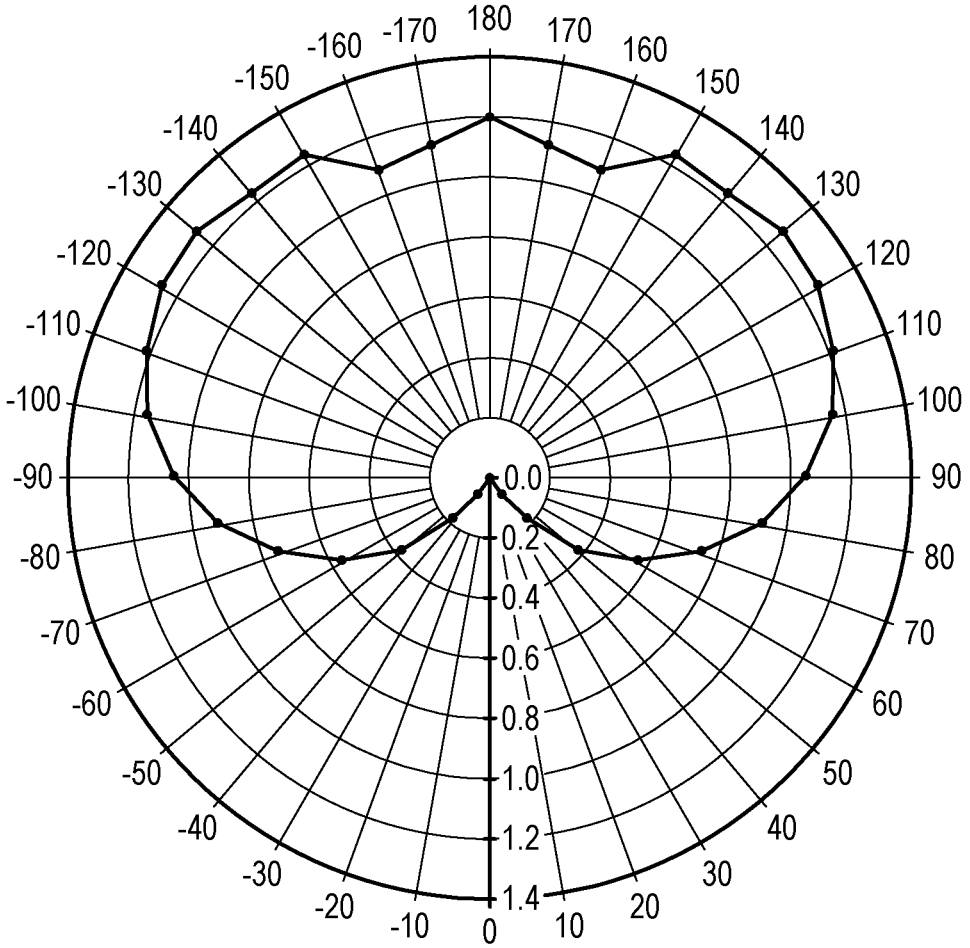
FIG. 4 schematically depicts a light distribution plot of a lighting device according to an embodiment of the present invention.
Figure 5:
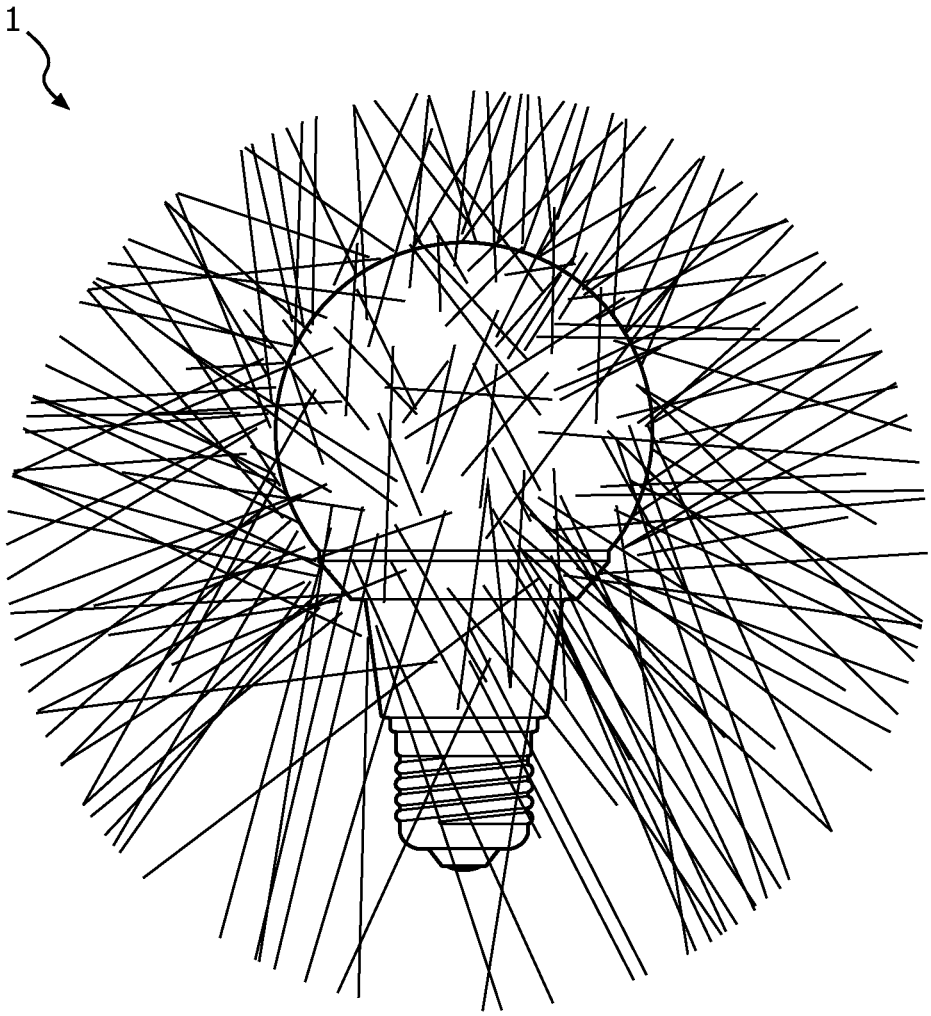
FIG. 5 schematically depicts a light distribution profile of a lighting device according to an embodiment of the present invention.

FIG. 4 schematically depicts a light distribution plot for such a 800 lm light bulb in which the second step 120 acts as a reflective surface and in which the bulbous member 10 and the second sidewall 122 are diffusively transparent. An impression of the light distribution produced by this lighting device 1 is also shown in FIG. 5. As can be seen from FIG. 4 and FIG. 5, a highly uniform light distribution can be obtained, which makes the lighting device 1 compliant with the well-known Energy Star regulations, as previously explained. It is noted for the avoidance of doubt that compliant luminous distributions may also be generated using a clear transparent bulbous member 10 and/or transparent member 100.

Figure 6:
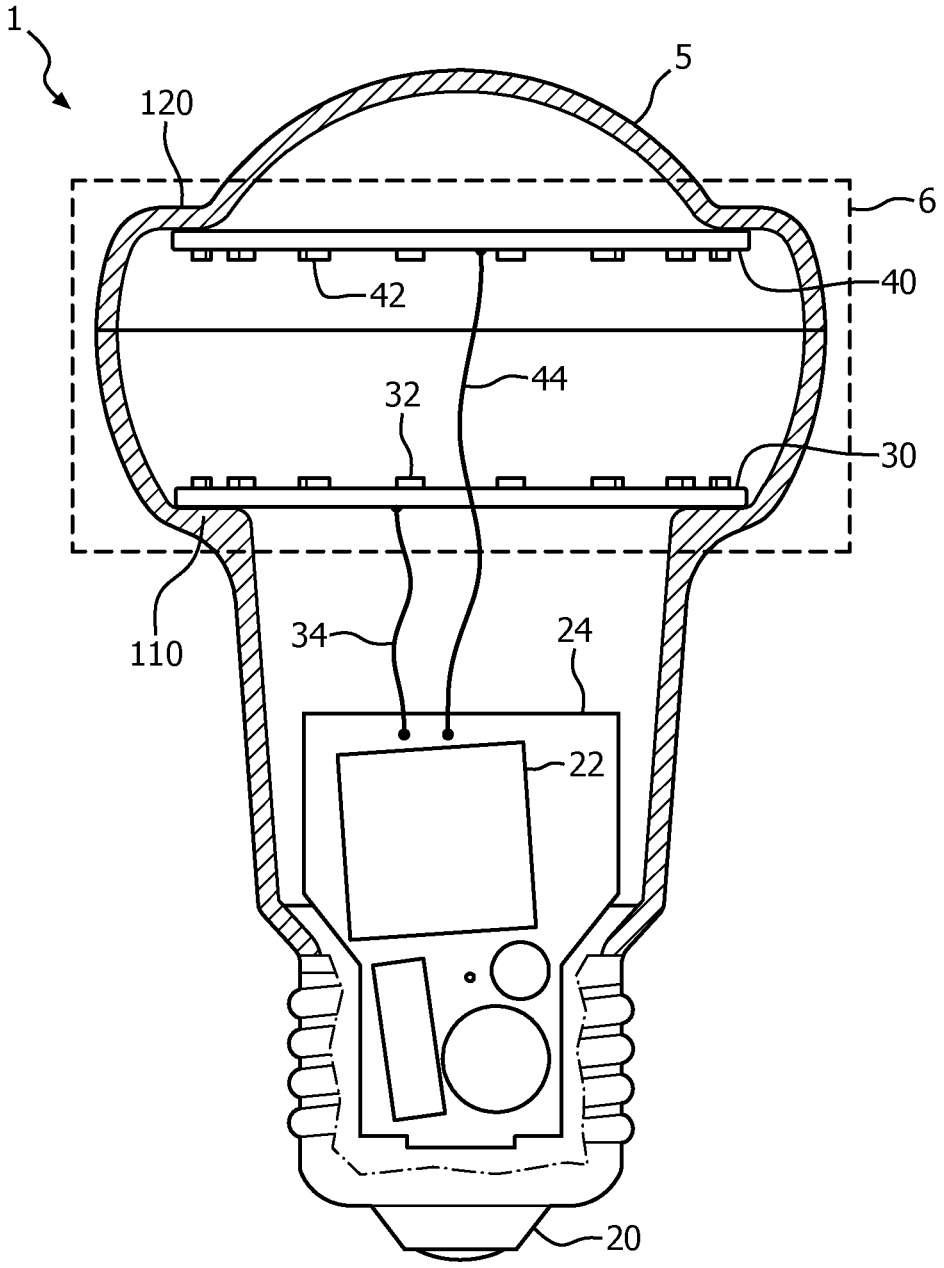
FIG. 6 schematically depicts a cross-section of a lighting device according to yet another embodiment of the present invention.
Figure 7:
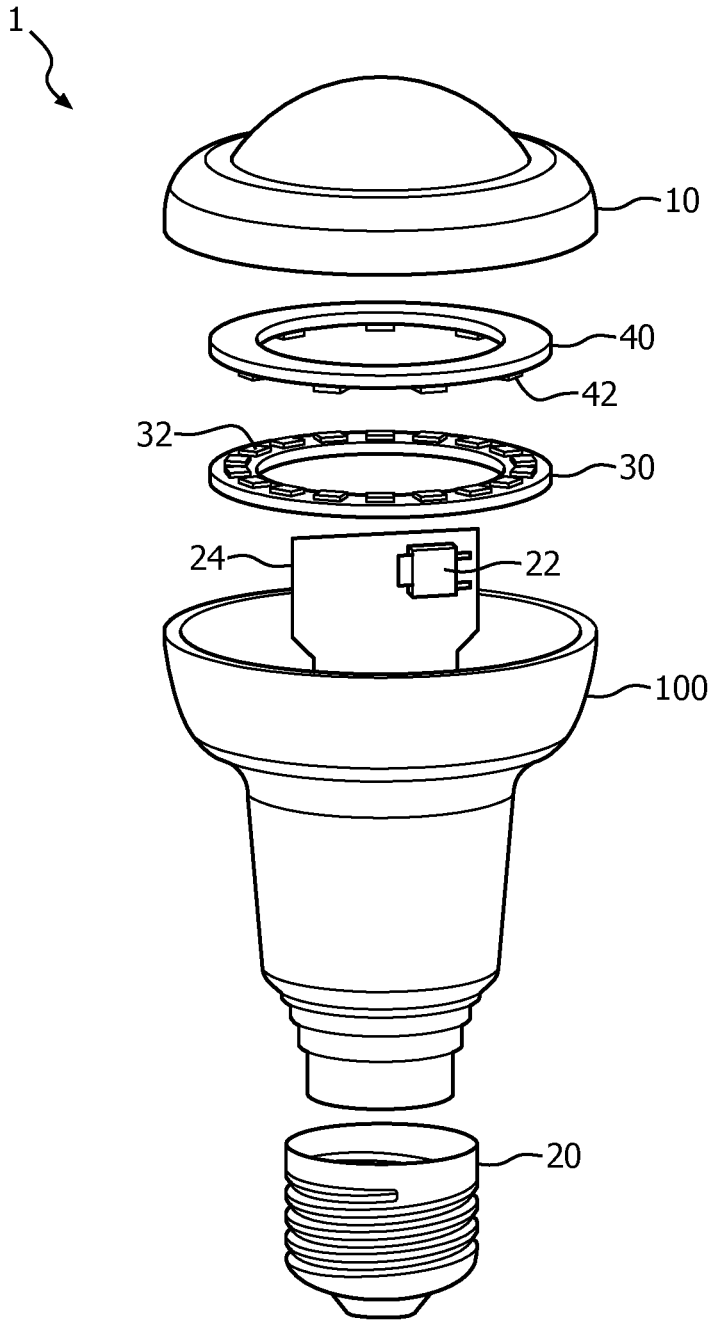
FIG. 7 schematically depicts an exploded view of the lighting device of FIG. 6.
Figure 8:
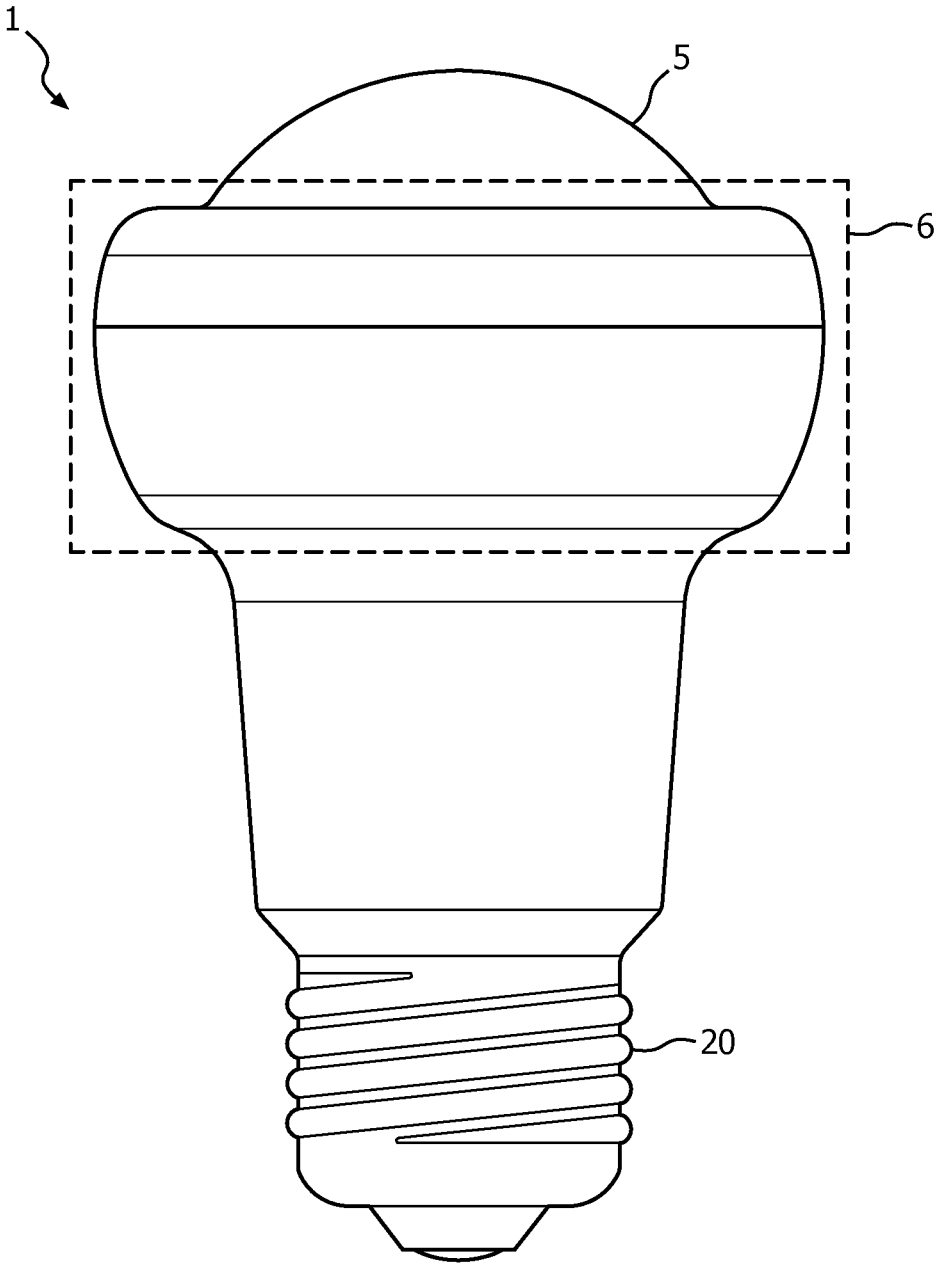
FIG. 8 schematically depicts a side-view of the lighting device of FIG. 6.

FIG. 6 schematically depicts a cross-section, FIG. 7 schematically depicts an exploded view and FIG. 8 schematically depicts a side view of a lighting device 1 according to yet another embodiment of the present invention. In the embodiment shown in FIG. 6-8, the first step 110 and second step 120 are located more centrally in the lighting device 1. As can be seen in particular in FIGS. 6 and 7, the bulbous body 5 comprises a part bulbous member 10, which may be transparent and a transparent member 100, wherein the part bulbous member 10 comprises the second step 120 and the transparent member 100 comprises the first step 110. As before, the second step 120 is axially displaced relative to the first step 110 along the central axis of the lighting device 1, wherein the first step 110 is located in between the second step 120 and the cap 20.

The first step 110 and the second step 120 may delimit an annular protrusion 6 of the bulbous body 5. In other words, the annular protrusion 6 extends from the first step 110 to the second step 120. The annular protrusion 6 may have a curved outer surface to improve the appearance of the lighting device 1.

The part bulbous member 10 and the transparent member 100 may cooperate to form the bulbous body 5, e.g. the part bulbous member 10 and the transparent member 100 may be threaded such that they can be screwed together, or may be fused together to form the bulbous body 5. The part bulbous member 10 and the transparent member 100 may be made of the same or different materials, e.g. the same or different polymer materials. In an embodiment, the part bulbous member 10 and the transparent member 100 are made of the same polymer material, e.g. a thermal plastic such as polyphenylene sulfide (PPS), polycarbonate, polyethylene terephthalate or poly (methyl methacrylate), i.e. a plastic having favourable thermal conductivity properties. PPS is particularly preferred.

As before, the first step 110 comprises a first carrier 30 such as a PCB onto which a first plurality of SSL elements 32 is mounted in any suitable fashion and in any suitable pattern, e.g. an annular pattern. Although not explicitly shown, the first carrier 30 may be omitted and the first plurality of SSL elements 32 may be mounted directly on the first step 110 in an alternative embodiment. The second step 120 comprises a second carrier 40 such as a PCB onto which a second plurality of SSL elements 42 is mounted in any suitable fashion and in any suitable pattern, e.g. an annular pattern. Although not explicitly shown, the second carrier 40 may be omitted and the second plurality of SSL elements 42 may be mounted directly on the first step 110 in an alternative embodiment. The first carrier 30 and the second carrier 40 preferably are annular carriers, such that light generated by the SSL elements 32 and 42 can travel through the aperture in the respective carriers to reach the part bulbous member 10 and the transparent member 100.

The first plurality of SSL elements 32 and the second plurality of SSL elements 42 are arranged such that the luminous surfaces of the first plurality of SSL elements 32 face the luminous surfaces of the second plurality of SSL elements 42, i.e. the respective pluralities of SSL elements are arranged to emit light in each other's directions. It has been found that this particular arrangement is capable of generating a luminous output that is compliant with the Energy Star regulations, and is furthermore capable of generating a luminous output with high efficiency; optical efficiencies in excess of 90% can be achieved with this arrangement. In other words, the lighting device 1 as shown in FIG. 6-8 is capable of highly efficient luminous generation with minimal light loss, e.g. through absorption by components of the lighting device 1.

In an embodiment, the lighting device 1 further comprises a driver circuit 22 for driving the respective SSL elements of the lighting device 1, which driver circuit may be mounted on a suitable carrier 24 such as a PCB. The driver circuit 22 (and carrier 24) may be mounted in the cap 20, and may extend into the bulbous body 5. The first plurality of SSL elements 32 and the second plurality of SSL elements 42 may be electrically connected to the driver circuit 22 in any suitable manner, for instance using flying wires 34 and 44 as shown in FIG. 6, although it should be understood that any suitable connection may be used; for instance, the carrier 24 may comprise a pin connector (not shown), wherein the first carrier 30 and the second carrier 40 engage with the pin connector through respective pins (not shown). Other alternatives will be immediately apparent to the skilled person.

In an embodiment, the bulbous body 5 may be diffusely transparent in its entirety, e.g. may act as a diffuser, in order to give the lighting device 1 the desired aesthetic appearance.

As should be appreciated from in particular FIG. 7, the lighting device 1 can be assembled in a straightforward manner, such that the lighting device 1 can be manufactured at relatively low cost.

In an embodiment, the lighting device 1 is a light bulb. The light bulb may have any suitable size. As such sizes are known per se to the skilled person, a long list of suitable sizes is omitted for the sake of brevity only.

The lighting device 1 according to embodiments of the present invention may be advantageously included in a luminaire such as a holder of the lighting device, e.g. a ceiling light fitting, a lamp holder or an apparatus into which the lighting device is integrated, e.g. a cooker hood or the like to produce a luminaire that can produce a highly uniform luminous distribution.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising a bulbous body mounted on a cap, an inner surface of the bulbous body comprising a plurality of steps that are axially displaced relative to each other along a central axis of the lighting device, said plurality of steps comprising:

a first step supporting a first plurality of solid state lighting elements; and a second step supporting a second plurality of solid state lighting elements, wherein the first step is located in between the cap and the second step;

said bulbous body further comprising a bulbous member separated from the cap by a transparent member having a stepped wall profile including the first step and the second step, wherein the first plurality of solid state lighting elements is mounted on a first carrier and the second plurality of solid state lighting elements is mounted on an annular second carrier, and at least one of the second step and the annular second carrier has a reflective surface facing the first plurality of solid state lighting elements.

2. The lighting device of claim 1, wherein:

the first plurality of solid state lighting elements and the second plurality of solid state lighting elements are arranged to emit light towards the bulbous member;

the second step is located in between the first step and the bulbous member and has a larger diameter than the first step; and the transparent member and the bulbous member combine to form the bulbous body.

3. The lighting device of claim 2, wherein at least one of the transparent member and the bulbous member is made of a polymer material.

4. The lighting device of claim 3, wherein the transparent member is made of a thermal plastic selected from a group of polyphenylene sulfide, polycarbonate, polyethylene terephthalate and poly methylmethacrylate.

5. The lighting device of claim 2, wherein the transparent member comprises an aperture facing the cap, a first sidewall extending from said aperture to the first step and a second sidewall extending from the first step to the second step, wherein the second sidewall optionally is diffusively transparent.

6. The lighting device of claim 1, wherein the surface of the second step facing the first plurality of solid state lighting elements is a diffusive surface.

7. The lighting device of claim 1 wherein the cap comprises a driver circuit for driving the first plurality of solid state lighting elements and the second plurality of solid state lighting elements.

8. The lighting device of claim 7, wherein said driver circuit extends into the bulbous body.

9. The lighting device of 7 wherein the first plurality of solid state lighting elements and the second plurality of solid state lighting elements are electrically connected to the driver circuit by respective flying wires.

10. The lighting device of claim 7, wherein the bulbous member is a diffuser.

11. A luminaire comprising the lighting device of claim 10.

* * * * *